US012607182B2

(12) United States Patent
Araci et al.

(10) Patent No.: US 12,607,182 B2
(45) Date of Patent: Apr. 21, 2026

(54) STRAIN-ACTUATED MICROFLUIDIC PUMP SENSOR

(71) Applicant: Santa Clara University, Santa Clara, CA (US)

(72) Inventors: Ismail Emre Araci, San Jose, CA (US); Caroline Barbar Askar, San Jose, CA (US); Nick Cmager, Santa Clara, CA (US)

(73) Assignee: Santa Clara University, Santa Clara, CA (US)

( * ) Notice: Subject to any disclaimer, the term of this patent is extended or adjusted under 35 U.S.C. 154(b) by 0 days.

(21) Appl. No.: 19/071,580

(22) Filed: Mar. 5, 2025

(65) Prior Publication Data

US 2025/0290501 A1 Sep. 18, 2025

Related U.S. Application Data

(60) Provisional application No. 63/565,718, filed on Mar. 15, 2024.

(51) Int. Cl.

| | |
|---|---|
| ***F04B 43/08*** | (2006.01) |
| ***F04B 19/00*** | (2006.01) |
| ***F04B 19/04*** | (2006.01) |

(52) U.S. Cl.

CPC ..... *F04B 43/084* (2013.01); *F04B 19/006* (2013.01); *F04B 19/04* (2013.01)

(58) Field of Classification Search

CPC ..... F04B 43/084; F04B 19/006; F04B 19/04

See application file for complete search history.

(56) References Cited

U.S. PATENT DOCUMENTS

| | | | | |
|---|---|---|---|---|
| 1,580,479 | A * | 4/1926 | Frankenfield | F04B 43/088 92/39 |
| 3,148,624 | A * | 9/1964 | Baldwin | F04B 43/086 417/478 |
| 3,630,644 | A * | 12/1971 | Bellhouse | F04B 43/10 417/389 |
| 5,346,369 | A * | 9/1994 | Miller, Jr. | F03B 13/20 417/328 |
| 9,395,050 | B2 * | 7/2016 | Kornilovich | F04B 43/04 |
| 9,588,100 | B2 * | 3/2017 | Appleyard | G01N 1/44 |
| 11,187,224 | B2 * | 11/2021 | Xia | B01L 3/502761 |
| 11,415,503 | B2 * | 8/2022 | Appleyard | G01N 15/1484 |
| 2005/0133371 | A1 * | 6/2005 | Timperman | G01N 27/44752 204/600 |
| 2008/0166188 | A1 * | 7/2008 | Gilbert | B07C 5/34 406/198 |

(Continued)

FOREIGN PATENT DOCUMENTS

| | | | | |
|---|---|---|---|---|
| WO | WO-2020233791 | A1 * | 11/2020 | F04B 19/006 |

OTHER PUBLICATIONS

Reeder et al., "Resettable skin interfaced microfluidic sweat collection devices with chemesthetic hydration feedback," Nat Commun, vol. 10, No. 1, Dec. 2019, doi: 10.1038/s41467-019-13431-8.

(Continued)

*Primary Examiner* — Christopher S Bobish

(74) *Attorney, Agent, or Firm* — LUMEN PATENT FIRM

(57) ABSTRACT

A skin-strain-actuated microfluidic pump (SAMP) is provided that utilizes asymmetric aspect ratio of pumping channels for the recording of human activity in the fluidic domain.

5 Claims, 17 Drawing Sheets

(56) References Cited

U.S. PATENT DOCUMENTS

2015/0024373 A1* 1/2015 Xia ..... F04B 43/043
435/308.1
2021/0106995 A1* 4/2021 Araci ..... G01B 7/18

OTHER PUBLICATIONS

Li et al., "Stretch-driven microfluidic chip for nucleic acid detection," Biotechnol Bioeng, vol. 118, No. 9, pp. 3559-3568, Sep. 2021, doi: 10.1002/BIT.27839.
Mishra et al, "A Soft Wearable Microfluidic Patch with Finger-Actuated Pumps and Valves for On-Demand, Longitudinal, and Multianalyte Sweat Sensing," ACS Sens, vol. 7, No. 10, pp. 3169-3180, Oct. 2022, doi: 10.1021/ACSSENSORS.2C01669/SUPPL_FILE/SE2C01669_SI_002.MP4.
Liu et al., "Strain-Tunable Microfluidic Devices with Crack and Wrinkle Microvalves for Microsphere Screening and Fluidic Logic Gates," ACS Appl Mater Interfaces, vol. 13, No. 31, pp. 36849-36858, Aug. 2021, doi: 10.1021/ACSAMI.1C08745/SUPPL_FILE/AM1C08745_SI_001.PDF.

* cited by examiner

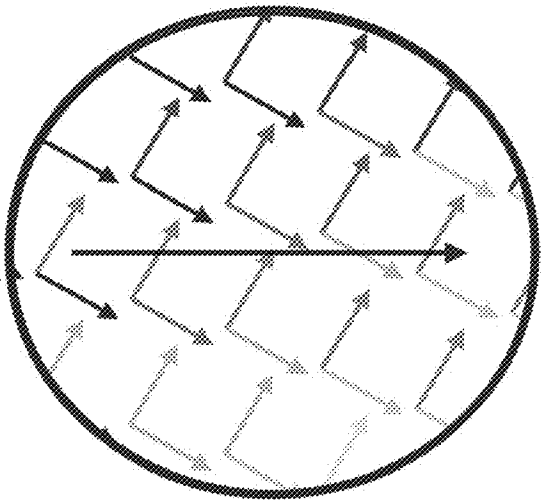
FIG. 6D
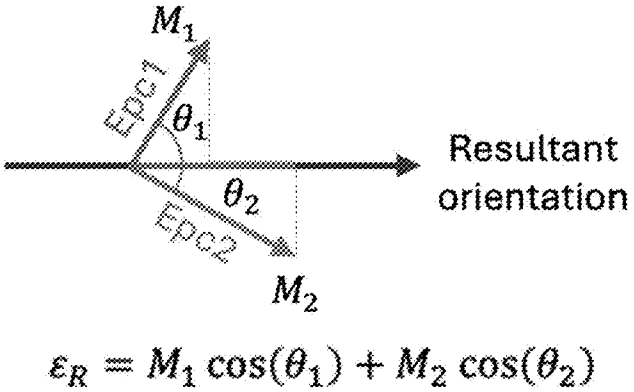
FIG. 6E
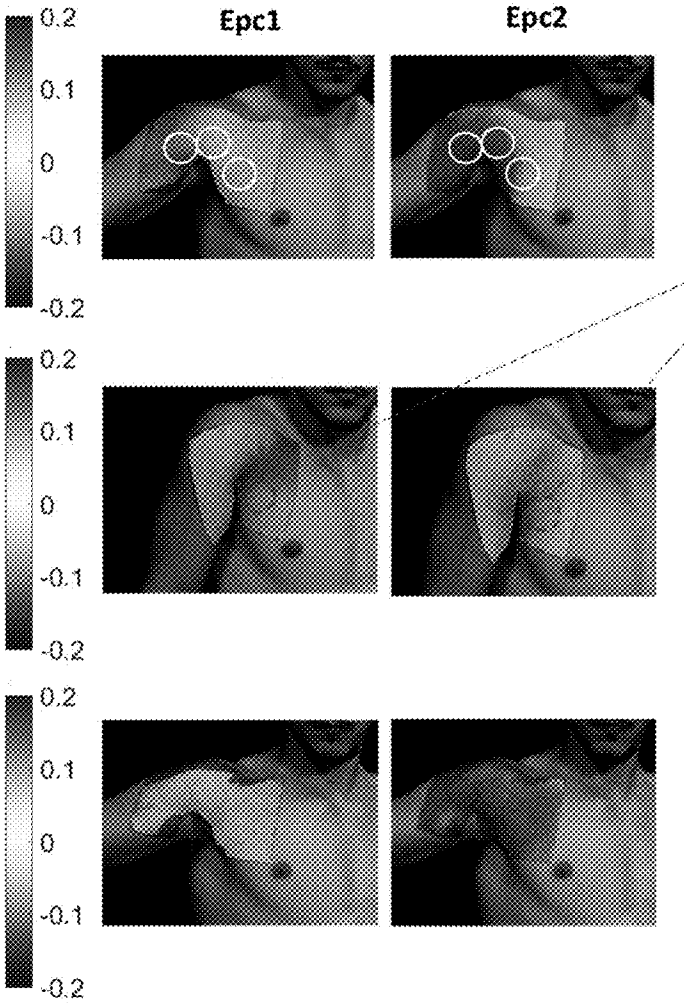
FIG. 6A
FIG. 6B
FIG. 6C

STRAIN-ACTUATED MICROFLUIDIC PUMP SENSOR

CROSS-REFERENCE TO RELATED APPLICATIONS

This application claims priority from U.S. Provisional Patent Application 63/565,718 filed Mar. 15, 2024, which is incorporated herein by reference.

STATEMENT OF GOVERNMENT SPONSORED SUPPORT

This invention was made with Government support under contract 2045087 awarded by the National Science Foundation. The Government has certain rights in the invention.

FIELD OF THE INVENTION

This invention relates to strain-actuated microfluidic sensors.

BACKGROUND OF THE INVENTION

In recent years, there has been considerable interest in the development of skin-mountable strain sensors (SMSSs) for human movement tracking. These sensors can particularly help with the monitoring of rehabilitation programs for patients suffering from musculoskeletal diseases or exercise tracking for sports analytics applications.

Several strategies were developed to improve the sensitivity (i.e., gauge factor (GF)), stretch-ability, and linearity, as well as to reduce the hysteresis of SMSSs. Capillaric SMSSs have been developed by the inventors utilize fluid flow to enhance the sensitivity of strain sensing, as well as to enable integrated sensor networks toward movement recognition. Some of the attractive features of SMSSs are their ability to detect skin deformations due to the movement of the joint, as well as the muscle, and to provide continuous data. Typically, near-field communication (NFC) or Bluetooth integration has been used for a continuous readout. The wireless transfer of electrical signals with such methods requires relatively complex and costly flexible or rigid electronic components to be integrated into the skin regardless of the sensing technology. A potential solution to eliminate the need for electronics for data transfer is an image-based readout. This method is typically used in colorimetric sweat-sensing applications using microfluidic wearables. In a standard application, the sweat interacts with a chromogenic target, which changes color after a chemical reaction. The color change can be recorded with a smartphone. Another wearable device technology that relies on an image-based readout is intraocular pressure (IOP) sensing in microfluidic contact lenses. In this case, instead of the color, the liquid meniscus position is measured by a camera to determine the IOP. For both applications, the required measurement time intervals are in the order of minutes or larger, eliminating the continuous data transfer need and making the image-based readout a suitable power- and electronics-free method.

However, in human-activity-tracking applications, the biomechanical changes occur at the time scale of seconds or faster and are repeated continuously. Therefore, an image-based readout for continuous data transfer cannot be possible without video recordings, which would negate the simplicity advantage of the image-based readout. In some cases, however, the continuous transfer of movement data is not necessary; instead, single-time data that summarizes the activity type or its number of repetitions is sufficient (e.g., fitness or sleep trackers providing daily or weekly activity trends). Summarized data can reduce the data volume and increase the efficiency of processing by reducing the computational load. With a microfluidic device that responds to the aggregated activity, a single image will inform the user of the summary of the activity type, intensity, or repetition. The present invention introduces the art of skin-strain-actuated microfluidic pumps (SAMPs) for detecting and recording of activity type, intensity and repetition.

SUMMARY OF THE INVENTION

A microfluidic device is described that operates in one embodiment as a tensile strain actuated liquid micro-pump. The micro-pump device includes an observation channel that allows the imaging of a liquid/air interface position. The interface position changes permanently depending on the amplitude, direction, and the number of repetitions of the applied cyclic strain. The position of the air/liquid interface at the end of an activity period informs the user of the intensity, type, and quantity of an activity. The interface position is determined by a camera. The device is thin and is skin mountable or mountable to any surface that experience stretch or strain.

Due to the complex nature of the human movements, an array of such devices can be adhered to the human skin to track the complex human movements. The images from multiple devices are used as features to classify different types of movements/exercises.

Embodiments of this invention allow human movement/exercise tracking without any electronics. The device does not require rigid components, which allows easy and comfortable use of the device. The application areas are in sports analytics and physical rehabilitation management.

Since the pumping efficiency changes due to subtle variations even in the repetitions of the same movements, machine-learning models have to be used to correctly assess the images to determine the activity type, intensity, and quantity.

In another embodiment, a microfluidic device is described that can store strain human activity information for image-based detection and classification of human movements/exercises.

Embodiments have three integrated components. An array of integrated microfluidic pump devices that adheres to the skin. An individual device structure has three main parts (actuator, pumping channels, and observation section). At $t_1$ the device is stretched uniaxially. The strain on the actuator causes the volume of the microfluidic channels that make up the actuator to increase. This volume increase applies a vacuum and pulls the liquid from the observation section (OS) towards the actuator. The same strain on the pressure channels causes them to deform. The two sides of the pumping channels (PC) have different architectures from each other. In the case of proof-of-concept experiment, each side of PC are designed asymmetrically. Due to the different architectures of the two sides of the PCs, they deform differently that causes a difference in their hydraulic resistances with respect to each other. This hydraulic resistance difference causes the liquid displacement in OSs to be different under strain. When the stress is released at $t_2$, the PCs return to the undeformed positions, which causes the liquid displacement on both sides to be equal in the reverse direction.

The design considerations of each component and alternative strategies are described as follows.

1) Actuator: The actuator has parallel straight fluidic channels or concentric circular channels filled with a liquid. The tensile strain on the actuator either causes its volume to increase or decrease depending on the channel architecture. The applied strain causes negative (positive) pressure to be applied to the liquid. When the strain is released during a strain cycle the pressure becomes positive (negative) again. The architecture of the individual channels also changes the value of the volumetric strain ($\Delta V/V$). The total volume, V, can be increased by adding more parallel or concentric channels or by increasing the cross section of each of the channels.

2) Pumping channel (PC): PC is the key to the function of the strain-actuated pump. The PC is connected to the Actuator at its midpoint.
   a. One side of the PC (Side 1) has a different architecture than the other side (Side 2).
   b. The center of the PC can include a tapered section to make a transition between side 1 and side 2.
   c. The length of the PC determines the pumping efficiency. The longer the PC the larger the pumping performance will be observed.
   d. The orientation of the PC can be parallel or perpendicular to the orientation of the actuator channels.
   e. Some possible PC design considerations are as follows
      i. the aspect ratio of one side is reversed on the other side (e.g. Height to width ratio on one side is 1:5 and on the other side it is 5:1).
      ii. One side can have circular, elliptical or triangular cross section and the other have a rectangular cross section.
      iii. One side have a large cross section and the other side have small cross-section.
      iv. One side deforms differently under strain than the other side.
      v. One side is made from a different material than the other one.
      vi. One side has a different hydraulic resistance than the other side.
      vii. One side has triangular/trapezoidal features directed away from the center and the other side has triangular/trapezoidal features directed at the center
      viii. One side has a tesla valve directed away from the center and the other side has a tesla valve directed to the center
   f. Multiple asymmetric PC pairs can be connected to a single actuator.

3) The observation sections (OSs). There are two OSs that are connected to each side of the PC. OSs on one end are connected to PC and open to air on the other end (outlet). The liquid interface position in the OSs will change depending on the number of the repetitions of the cyclic strain and their amplitude and direction. Depending on these parameters;
   a. Liquid interface in both OSs can advance towards the outlet
   b. Liquid interface in both OSs can advance towards the PC
   c. Liquid interface in one OS can advance towards PC while others advance towards the outlet.

The position of the liquid interface in each OS is measured and used as a feature for data analysis.

Devices can be made from a flexible polymer such as PMMA or PDMS.

Multiple devices with various designs (i.e., different actuator orientation, architecture volume, different PC length, orientation, materials, architecture) can be fabricated on a single substrate and adhered to the skin altogether or they can be individually fabricated and adhered to the different parts of the body separately.

The array of devices can be orderly or randomly distributed.

The position of each device can be determined using a prior strain mapping study (e.g., by digital image correlation) or by a biomechanical analysis (e.g., gait analysis, skin elasticity measurements, etc.).

The two critical peripheral components that are required for the sensor to function is as follows.

A) Imaging instrument. This can be a smartphone camera. The smartphone is used to take the images of all the devices to determine the interface positions in both OSs.

B) An algorithm can be implemented to classify the movements based on the interface positions from all the OSs.

In another embodiment, the invention can be characterized as a skin-strain-actuated microfluidic pump (SAMP). The SAMP has three components:

(1) an actuator channel capable of generating a fluidic pumping action caused by a skin strain.
(2) two asymmetric pumping channels fluidically connected to the actuator channel, where cross-sections of each of the two asymmetric pumping channels are asymmetric from each other.
(3) two observation channels fluidically connected to the two asymmetric pumping channels for observing and quantifying an amount of fluid transferred from one of the asymmetric pumping channels to the other asymmetric pumping channel.

The SAMP relies on a difference in deformation characteristics of each of the two asymmetric pumping channels caused by the asymmetry of the cross-sections resulting in an asymmetric flow in the two asymmetric pumping channels.

In one example, the difference in the deformation characteristics of each of the two asymmetric pumping channels caused by the asymmetry of the cross-sections is defined as a ratio in hydraulic resistance for each of the two asymmetric pumping channels.

In another example, the cross-sections of the two asymmetric pumping channels have an aspect ratio defined by a height to a width ratio of the respective cross-sections, where a difference or asymmetry in the aspect ratios causes the difference in the deformation characteristics of each of the two asymmetric pumping channels caused by the asymmetry of the cross-sections.

In yet another example, the cross-sections of the two asymmetric pumping channels are circular, elliptical or triangular with dimensional asymmetry from one cross-section to the other cross-section.

In still example, the SAMP has or uses a working liquid flowing through the actuator channel, the asymmetric pumping channels and the observation channels.

The embodiments described here allows the detection, recording, and transmission of movement data by an electronic free patch. This approach will enable simple, low-cost Band-Aid type of devices to be used for exercise tracking.

BRIEF DESCRIPTION OF THE DRAWINGS

Noted is that the original drawings in the priority document contain color. The reader is referred to the priority document for interpretation of the grey-scale in the accompanied drawings to this application.

(FIG. 1B) A schematic of the flexible chip where individual chip layers are shown separately. The pumping direction is from the high AR channel towards the low AR channel as shown. The cross-section schematic of the channels along the dashed line i) for high AR and ii) for low AR are shown in (FIG. 1A) before strain (solid line) and under strain (dashed line). The applied strain, ε, orientation is shown with bidirectional arrows in (FIG. 1B and FIG. 1C).

(FIG. 2B) A schematic showing the SAMP with arrows representing the fluid flow directions and amplitudes when strain is applied (left) and when strain is released (right). (FIG. 2C) A simplified equivalent electrical circuit model of APCs with arrows representing the flow directions and amplitudes when strain is applied (left) and when released (right). (FIG. 2D) Photos of a chip before strain is applied at t=0 (left), when strain is applied and held until steady state (middle), and when strain is released and held until steady state (right). The total volumetric displacement in each pumping channel after strain is applied and the net displacement after strain is released are indicated.

(FIG. 4B) The $V_{net}/V_{total}$ with respect to the number of SAMP actuations for three different device designs. The pumping channel cross section photos of each design are shown as an inset (top: symmetrical AR, middle: asymmetrical AR, bottom: identical cross-sections). The scale bars are 200 μm. (FIG. 4C) The $V_{net}/V_{total}$ with respect to the number of SAMP actuations for varying strain values for the asymmetric AR design shown in FIG. 4B. Three measurements were made on the same chip (i.e., Chip 1) and their averages were plotted. The error bars show the standard deviations of these experiments. Best linear fits and their $R^2$ values are shown. (FIG. 4D) The strain versus PE calculated using Eq. 12 in comparison to experimental PE (i.e., slope of the lines in (FIG. 4C) for three different chips and four different experiments (i.e., Chip 1 is tested two different ways; increasing strain and randomly applied strain). (FIG. 4E) PE measured at 5% strain (ε=0.05) for varying number of continuous strain cycles. (FIG. 4F) The $V_{net}/V_{total}$ with respect to the number of SAMP actuations for a continuous pumping channel (i.e., no observation channel) in comparison to a non-continuous pumping channel (i.e., with an observation channel). In (FIGS. 4B, 4C and 4F) The bottom grey shaded (negative values) side shows the HAR channel pumping towards the LAR and top white areas show LAR channel pumping towards the outlet.

(FIG. 5B) Volume displacement over the course of 100 actuations for two test subjects. Three different devices were tested on each subject and the averages were plotted. The error bars show the standard deviations of these experiments. Best linear fits and their $R^2$ values are also shown. The bottom grey shaded (negative values) side shows the HAR channel pumping towards the LAR and top white areas show LAR channel pumping towards the outlet.

FIGS. 6A-E show according to exemplary embodiments of the invention (FIG. 6A) First and second principal Lagrangian skin strains during shoulder movements of (FIG. 6A) abduction, (FIG. 6B) shrug, and (FIG. 6C) row. The white circle outlined on (FIG. 6A) shows the SAMP locations. Epc1 and Epc2 unit vectors plotted on the same SAMP location (FIG. 6D). Here, the blue arrows represent the Epc1 strain vectors; red arrows represent the Epc2 strain vectors. The 'color gradient' shows the strain magnitude values. The black arrow shows the sensor orientation. The depiction of resultant strain magnitude, ER calculation by adding Epc1 and 2 vector projections on the sensor orientation direction (FIG. 6E).

(FIG. 7B) The box plot showing the pumping rate dependency on the specific exercise for each SAMP. The letter (A, B, C) represents the location and the number (1, 2, 3) represents the type of the exercise.

DETAILED DESCRIPTION

For the development of a new type of skin-strain-actuated microfluidic pumps (SAMPs), the inventors have used the liquid displacement capability in capillaric strain sensors. In this design, repeated biomechanical changes (e.g., wrist or shoulder movement) cause an accumulated liquid displacement that is measured with a single image of the sensor. To generate a unidirectional flow from cycling applications of external forces (e.g., pressure, strain), the asymmetric flow characteristics (i.e., diodicity) of microchannels are needed. The asymmetric flow is typically achieved either by components that have moving parts (e.g., one-way valves) or by using nonlinear components (e.g., tesla valves, fluidic rectifiers).

The components with moving parts are difficult to fabricate and miniaturize. The nonlinear components, on the other hand, require high flow rates to provide asymmetric flow (i.e., high diodicity). An SAMP relies on the difference in the deformation characteristics of the microfluidic channels with different aspect ratio (AR=height/width). According to this principle, when strained in the direction orthogonal to the channel elongation, the hydraulic resistance (R) of the high-AR (>1) channels decreases while the R of the low-AR (<1) channels increases, providing asymmetric flow during the cycling application of the strain, independent of the flow rate. This mechanism without any moving parts is easier to fabricate and miniaturize. Such high-AR channels can be used for the generation of continuous pumping based on periodic skin-strain variations.

In this invention, a skin-strain-actuated microfluidic pump (SAMP) is provided that converts cyclic strain into linear liquid flow by utilizing asymmetric flow resistance. An analytical model was developed to calculate the pumping efficiency (PE). The PE is defined as the net volume displacement divided by the total volume displacement per cycle. By employing elastomeric polydimethylsiloxane (PDMS) devices and benchtop experiments, the inventors validated the congruence between the theoretical predictions and the measured PE.

Subsequently, experiments were conducted on two volunteers to record the liquid displacement that resulted from repetitive wrist bending. Finally, three of the SAMPs were used on a shoulder to distinguish three different shoulder exercises from each other. By leveraging 3D digital image correlation, the strain on the shoulder was quantified, revealing a correlation the volunteer trials. between the measured strain and the liquid displacement observed in the volunteer trials.

Device Design and Operation Mechanism

Figure 1A:
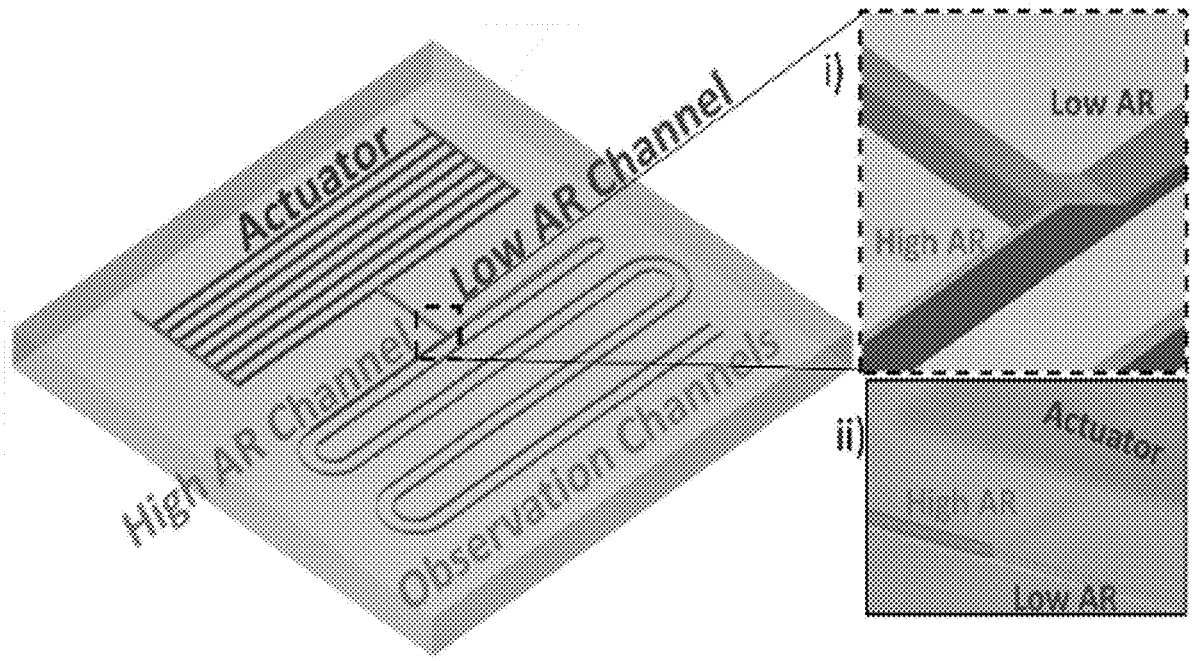
FIGS. 1A-C show according to exemplary embodiments of the invention (FIG. 1A) a 3-dimensional schematic of the SAMP design where individual components are labeled. The inset i) shows the dashed square zoomed in where the actuator component is connected to the asymmetric AR channels. The inset ii) is the photo of the same region of the 3D printed mold.
Figure 1B:
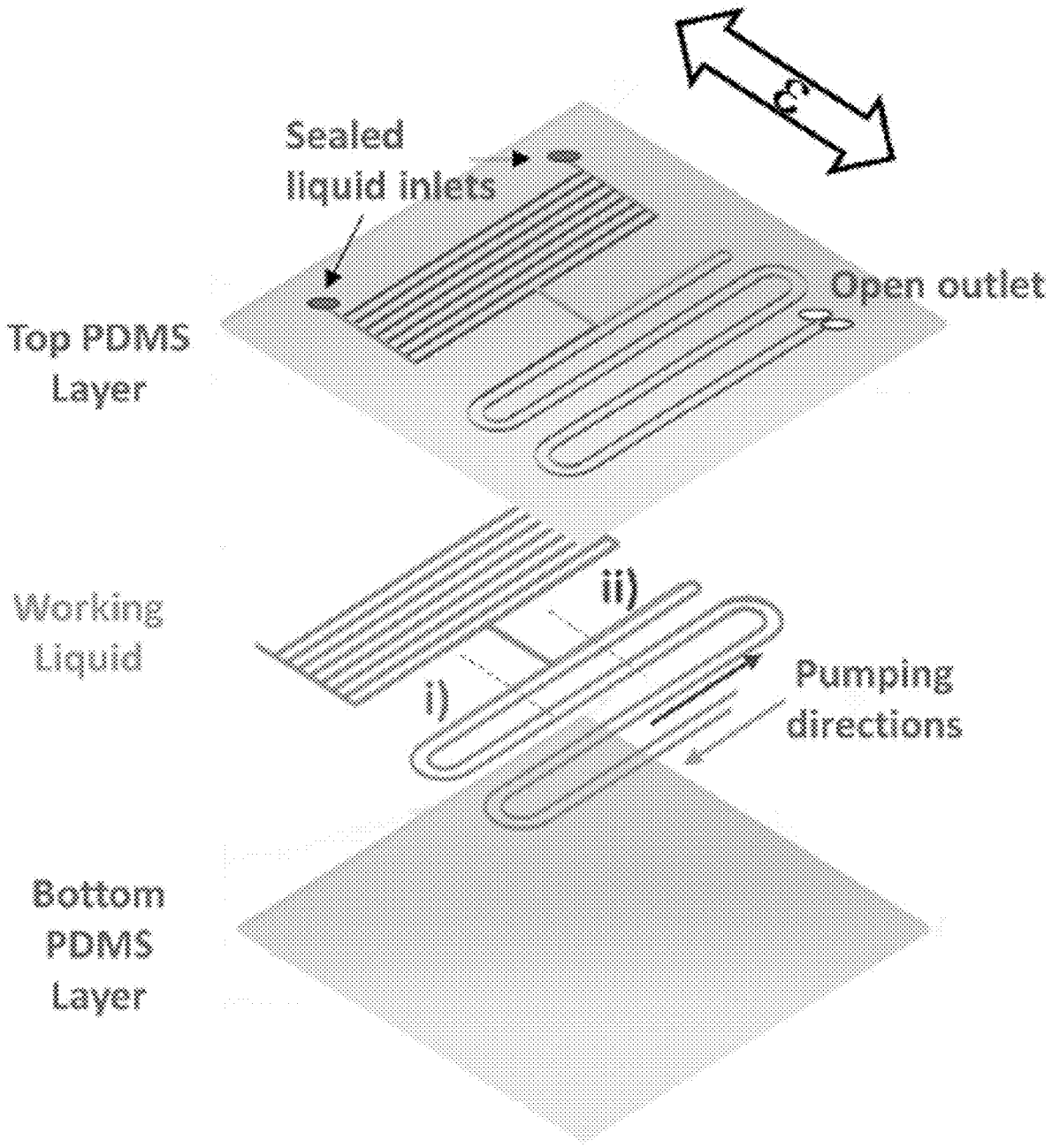
Figure 1C:
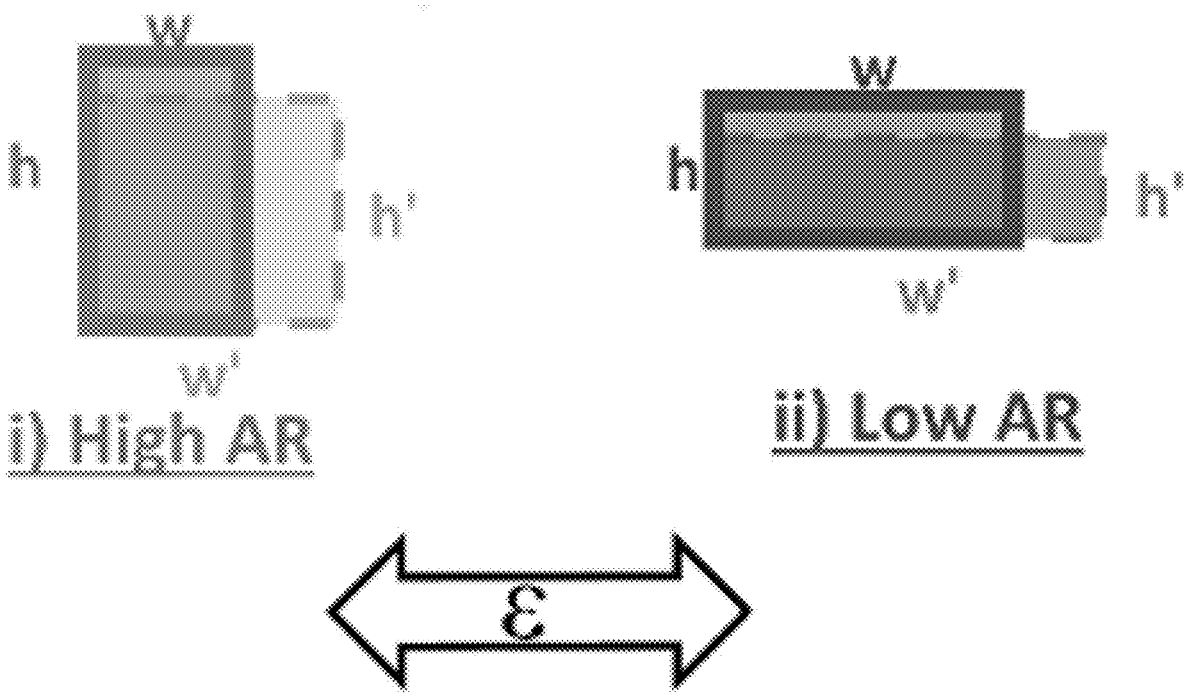

The SAMP design is composed of three components, a) actuator, b) asymmetric pumping channels (APC) (i.e., high aspect ratio (AR>1) versus low AR (<1)), and c) an optional observation channel as shown in FIG. 1A. The schematic showing different layers of a chip filled with a working ionic liquid (IL) is shown in FIG. 1B. When strain, ε in the direction shown, is applied, the i) high AR and ii) low AR pumping channel width, w, and height, h, deform as shown in FIG. 1C. When the strain is applied cyclically, the liquid in the observation channels is pumped from high AR channel towards low AR channels as depicted FIG. 1B in each period of the strain cycle. Here, the actuator is an array of parallel microfluidic channels that expand in volume (i.e., dilatation) under strain orthogonal to its elongation. According to the analysis results, when the membrane deformations are negligible (i.e., high spring constant), the actuator can be considered as a cyclic fluid flow source under applied cyclic strain. Here the inventors utilized the asymmetry in strain-induced deformation (ASID) of APC, to convert this cyclic flow into linear flow.

The hydraulic resistances of the low ($R_{LAR}$) and high ($R_{HAR}$) aspect ratio (AR) channels normalized with respect to length and viscosity are shown in Eq. 1 and 2, respectively [52];

$$R_{LAR} \propto \frac{1}{1-0.63\,AR}\frac{1}{h^3 w} \quad \text{Eq. 1}$$

$$R_{HAR} \propto \frac{1}{1-0.63\,AR^{-1}}\frac{1}{w^3 h} \quad \text{Eq. 2}$$

When these channels deform as shown in FIG. 1C, the new hydraulic resistances of the deformed channels, ($R'_{LAR}$ and $R'_{HAR}$) can be written as follows;

$$R'_{LAR} \propto \frac{1}{1-0.63\,AR'}\frac{1}{h'^3 w'} \quad \text{Eq. 3}$$

$$R'_{HAR} \propto \frac{1}{1-0.63\,AR'^{-1}}\frac{1}{w'^3 h'} \quad \text{Eq. 4}$$

Here, w'=w+εw; h'=h−εvh; aspect ratio, $$AR = \frac{h}{w};$$

and deformed aspect ratio, $$AR' = \frac{h'}{w'} = \gamma AR, \text{ where, } \gamma = \frac{1-0.5\,\varepsilon}{1+\varepsilon}$$

for Poisson's ratio, v=0.5. If ones assumes small strain and ignores the higher order terms, the deformed resistances can be written as follows.

$$R'_{LAR} \sim R_{LAR}\frac{(1-0.63\,AR)}{(1-0.63\,\gamma AR)}\frac{1}{\left(1-\frac{\varepsilon}{2}\right)} \quad \text{Eq. 5}$$

$$R'_{HAR} \sim R_{HAR}\frac{(1-0.63\,AR^{-1})}{(1-0.63\,(\gamma AR)^{-1})}\frac{1}{\left(1+\frac{5\varepsilon}{2}\right)} \quad \text{Eq. 6}$$

Here, it can be seen that as the strain increases, low AR resistance, (Eq. 5), increases because the denominator of both multiplier terms increases, while the high AR resistance, (Eq. 6), decreases, demonstrating that the ASID causes the hydraulic resistances of the low and high AR channels to change asymmetrically.

Equivalent Electrical Circuit Model for Pumping Efficiency Calculation

Figure 2A:
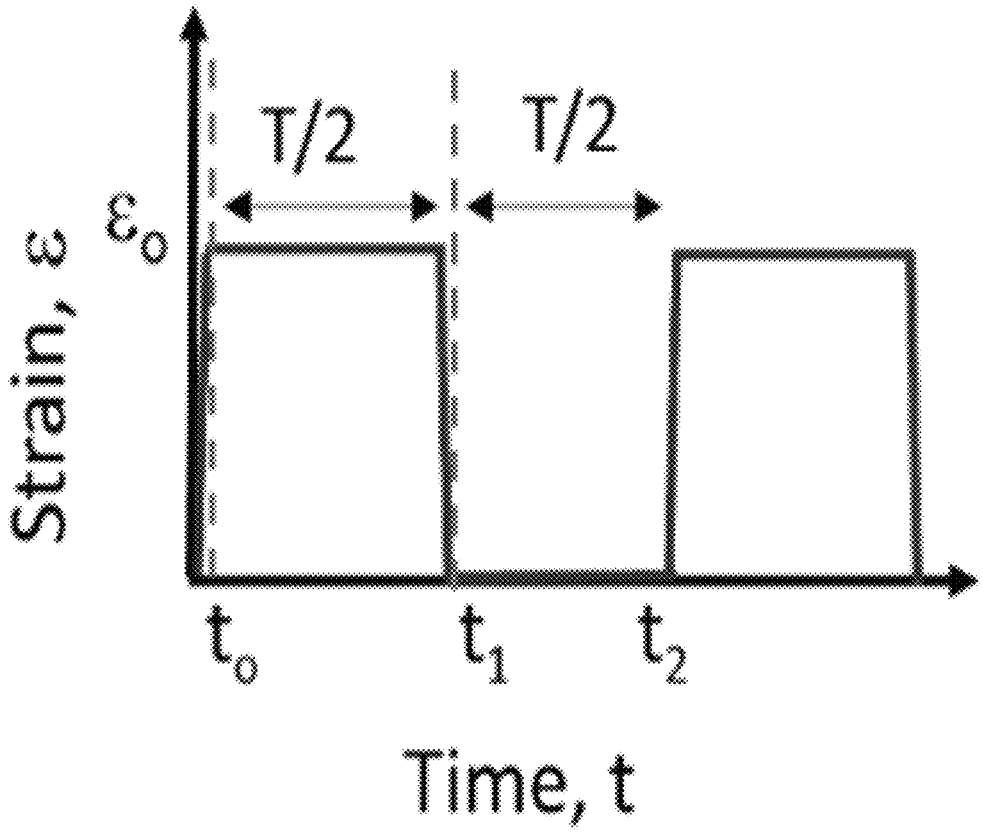
FIGS. 2A-D show according to exemplary embodiments of the invention (FIG. 2A) a periodic strain function applied to the SAMP.
Figure 2B:
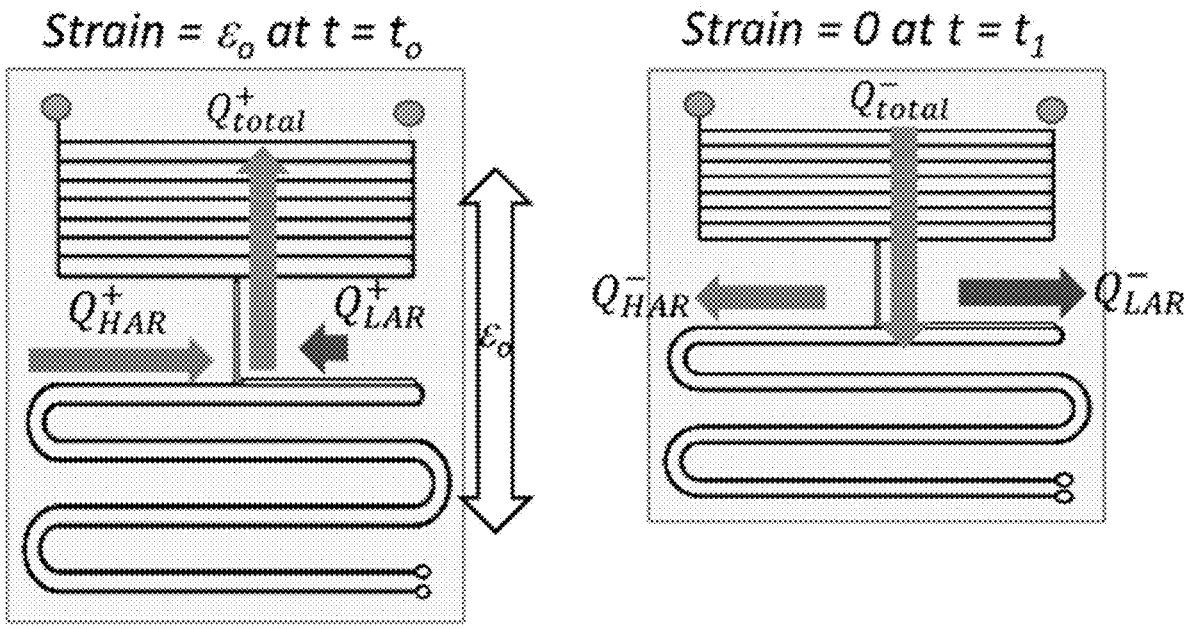
Figure 2C:
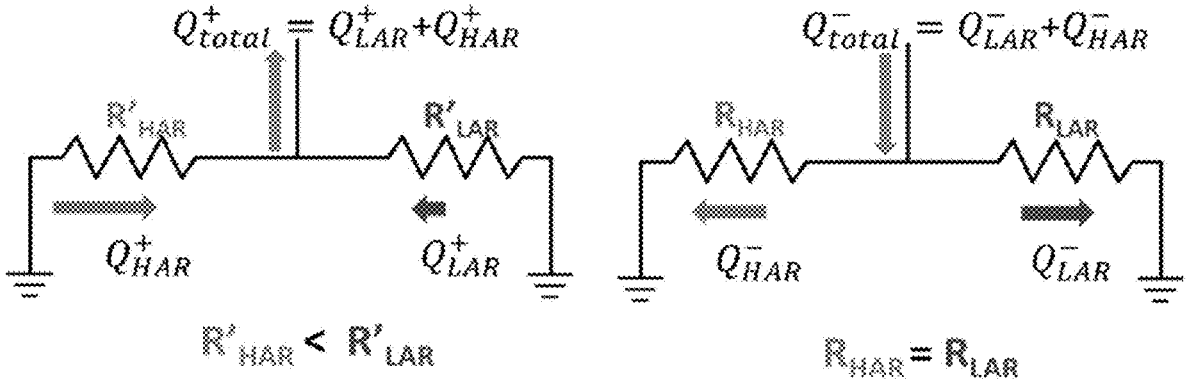

To theoretically demonstrate how the ASID leads to pumping and calculate the pumping efficiency (PE), the inventors have developed an electrical circuit (EEC) model of the APCs in the SAMP. Here it was assumed that a periodic strain function as shown in FIG. 2A is applied to the SAMP. When the strain is initially applied at $t_o$ the actuator applies vacuum due to the channel dilatation and creates flow, $Q^+_{total}$ as shown in FIG. 2B (left). Here the time dynamics of the strain application was neglected and assumed it is applied in an infinite small-time interval. The $Q^+_{total}$ is the sum of flow from high AR and low AR channels, $Q^+_{HAR}$ and $Q^+_{LAR}$, respectively. As shown in Eq. 5 and 6, under strain, the high AR channel resistance is lower leading to high flow, whereas the low AR channel has a higher resistance leading to lower flow. In the second half of the period, when the strain is released at $t_1$, the volume of the actuator returns to the original value applying positive pressure, hence creating flow in the opposite direction depicted as $Q^-_{total}$ in FIG. 2B (right). At this point, the resistances of the high and low AR channels return to the original values too, distributing the $Q^-_{total}$ equally into two sides of the pumping channels as $Q^-_{HAR}$ and $Q^-_{LAR}$. Here, it was assumed that the initial resistances of high AR and low AR channels are equal, however, this is not a strict requirement to get pumping as demonstrated both theoretically and experimentally in the next sections. The developed EEC model is shown in FIG. 2C. As seen, the APCs that are connected to the actuator are represented as two parallel resistors, where the inventors have neglected their compliance (i.e., capacitance) as they are much smaller in volume compared to the actuator component. Here in FIG. 2C, the inventors have created two models that correspond to the strained (left) and relaxed (right) APC, assuming steady-state operation in each half of the strain cycle. The dependence of flow on the resistances during the two halves of the strain cycle can be written as follows;

$$Q^{+}_{HAR} = \frac{R'_{HAR}}{R'_{LAR} + R'_{HAR}} Q^{+}_{total};\ Q^{+}_{LAR} = \frac{R'_{LAR}}{R'_{LAR} + R'_{HAR}} Q^{+}_{total} \quad \text{Eq. 7}$$

$$Q^{-}_{HAR} = \frac{R_{HAR}}{R_{LAR} + R_{HAR}} Q^{-}_{total};\ Q^{-}_{LAR} = \frac{R_{LAR}}{R_{LAR} + R_{HAR}} Q^{-}_{total} \quad \text{Eq. 8}$$

The difference between the two flow directions gives the net flow in each cycle as provided by the following equations;

$$Q^{NET}_{HAR} = Q^{+}_{HAR} - Q^{-}_{HAR} \quad \text{Eq. 9}$$

$$Q^{NET}_{LAR} = Q^{+}_{LAR} - Q^{-}_{LAR} = -Q^{NET}_{HAR} \quad \text{Eq. 10}$$

Figure 2D:
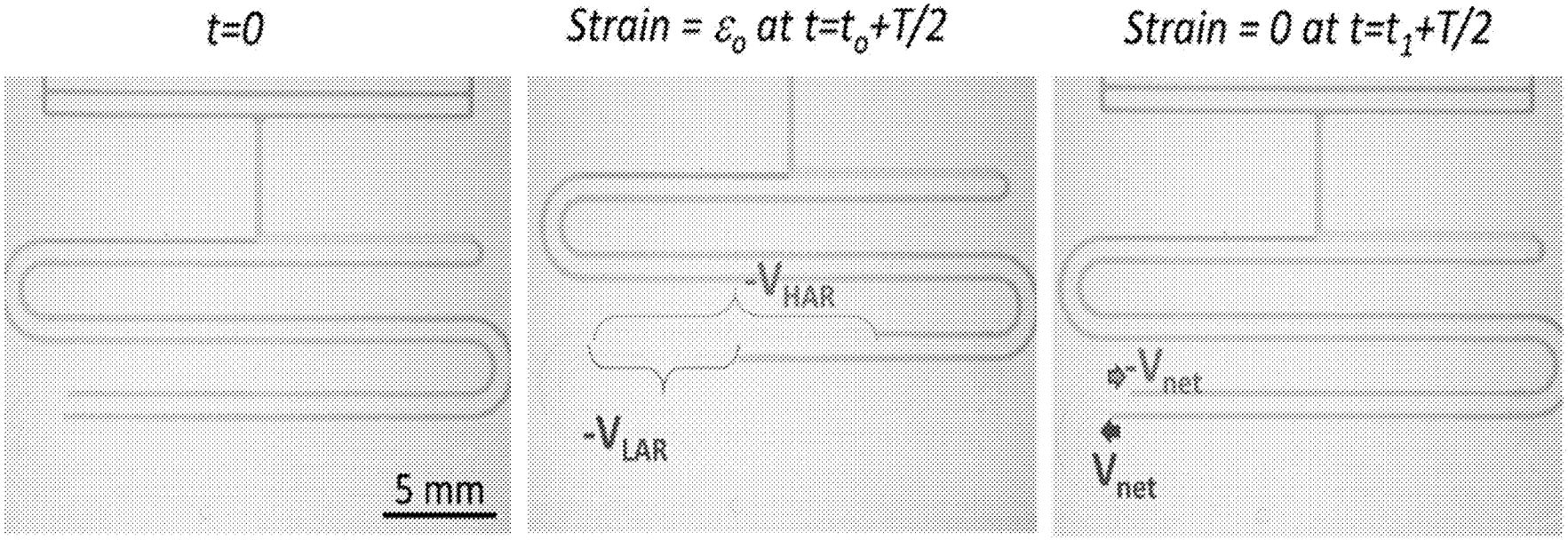

In the fluidic circuit, the flow is a function of time; therefore, instead of measuring the flow, we measure the volume displacement as shown in FIG. 2D.

The volume displacements can mathematically be expressed as follows;

$$V^{NET}_{HAR} = -V^{NET}_{LAR} = \int_0^T Q^{NET}_{HAR}\, dt \quad \text{Eq. 11}$$

Here, it is notable that the volume displacements in low AR and high AR channels are always equal and opposite in sign providing pumping (i.e., unidirectional flow from High AR to Low AR channel) or zero (i.e., no pumping occurs only for identical AR channels). The ratio of $V_{net}$ to $V_{total}$ (i.e., total volume displacement provided by the actuator) is defined as the PE and is expressed with the following equation obtained using Eqs. 7-11;

$$PE = \frac{R'_{HAR}}{R'_{LAR} + R'_{HAR}} - \frac{R_{HAR}}{R_{LAR} + R_{HAR}} \quad \text{Eq. 12}$$

PE is a critical performance parameter that varies with the asymmetry in pumping channel aspect ratios and strain, independently of the $V_{total}$. The $V_{total}$ can be increased separately from PE by making actuators with larger volumes.

Figures 3A, 3B:
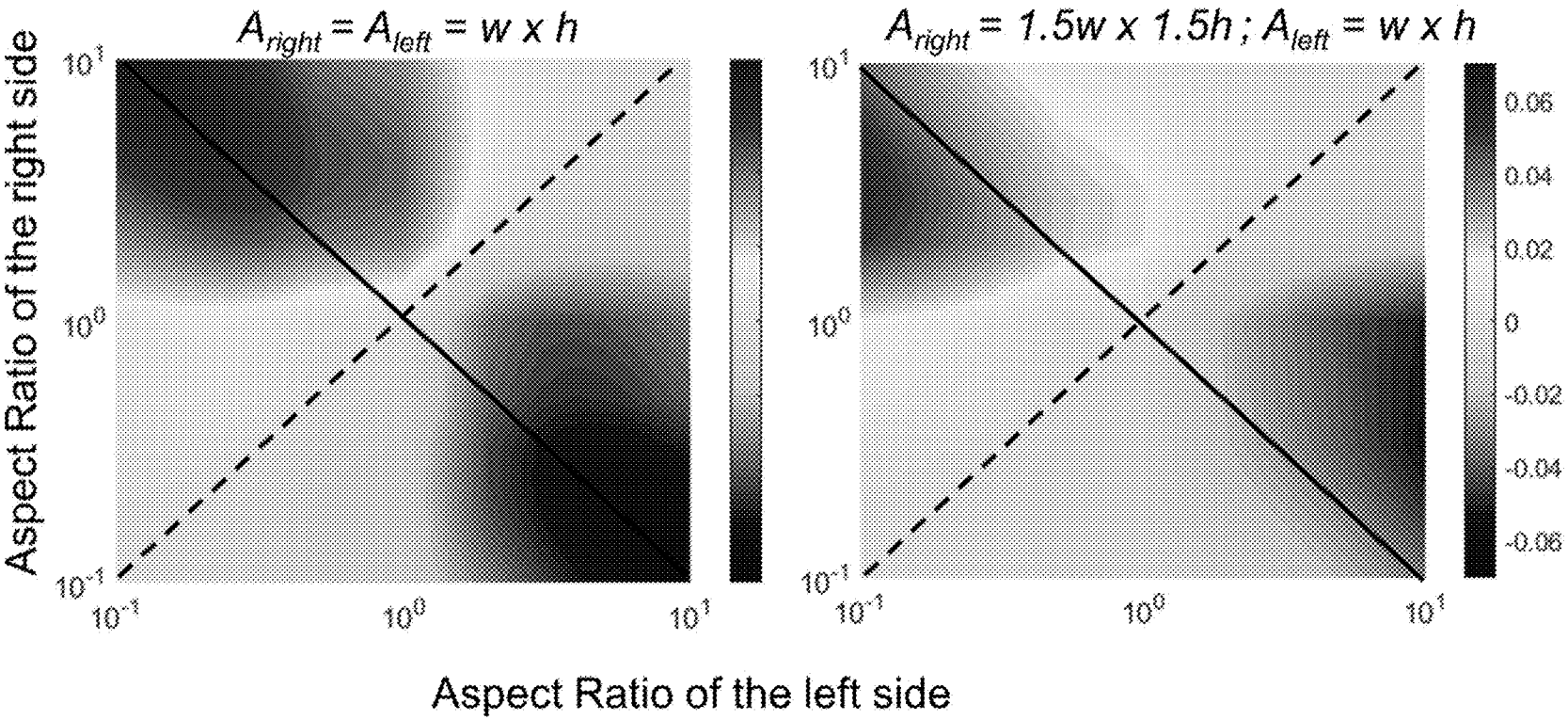
FIGS. 3A-B show according to exemplary embodiments of the invention heat maps of pumping efficiency, PE with respect to varying AR for left and right pumping channels at a strain, ε, of 0.1 assuming volume displacement from right to left, (FIG. 3A) when both sides have identical cross-section areas, and (FIG. 3B) when the right side has a width and height 1.5 times larger than the left side. The solid diagonal line shows the antisymmetric AR and the dotted diagonal line shows the symmetric AR combinations.

The theoretical PE for an AR range of 0.1 to 10 have been plotted and at a strain value of 0.1 in FIGS. 3A-B. As the values of AR are changed, the cross-section areas constant was kept constant. FIG. 3A shows the PE for a geometry where the cross-section areas are equal for both sides of the pumping channel. In FIG. 3B both the width and height of the right-side channel are increased by a factor of 1.5 to observe the effects of imbalance in resistances between the left and right side of the pumping channels. In both cases, the inventors observed that when the two sides have equal AR, marked with the dashed diagonal line, the PE is zero and there is no pumping. In contrast, when the two channels have asymmetrical AR, marked as the solid diagonal line, there is pumping from the high AR to the low AR channel. Here, the positive sign is assigned to volume displacement from right to left. Therefore, the 'blue color' (i.e., negative values) indicates left-to-right-flow. As a result, in all cases, the flow is from the high AR to the low AR channel. As the AR increases, PE increases reaching a maximum of 0.06 when the cross-section areas are equal (FIG. 3A). When the right-side cross-section area is larger (FIG. 3B), the maximum PE is lower and appears at an AR value closer to unity for the right-side channel. This is attributed to the lower resistance of the right side, which results in the same $V^{net}$ without requiring extreme AR values.

Materials and Methods

Fabrication of Molds

According to exemplary embodiments, molds were designed in Solidworks and then 3D-printed using a Formlabs stereolithography printer using Clear Resin. Printing was performed at the highest resolution of 0.025 mm. Printed molds were then washed in a dish filled with Isopropyl Alcohol (Techspray) which was placed in an ultrasonic bath (VWR International) for 45 minutes to remove residual resin. After air-drying, the molds were UV-cured using a UVC-1000 device (Hoefer Inc.) at maximum energy for 30 minutes.

Fabrication of Devices

Standard soft-lithography techniques have been modified to apply them to be used with 3D-printed molds. Briefly, for the top layer of PDMS (RTV 615, Momentive), a 10:1 ratio (A:B) of PDMS was degassed in a vacuum for 20 minutes and then spun onto the 3D-printed mold at 200 rpm providing a thickness of about 500 μm. The PDMS-coated 3D-printed mold was then subjected to a 10-minute degassing in a vacuum to remove bubbles, followed by being placed in an 80° C. oven to cure for 2 hours and then punched for inlet/outlet holes. Subsequently, a base layer of 20:1 ratio (A:B) PDMS was spun on a silicon wafer at 140 rpm, resulting in a 700 μm thickness. This base layer was placed in the 80° C. oven for 6 minutes to partially cure before being thermally bonded to the top layer and placed in the 80° C. oven for 2 hours. The choice of thermal bonding is crucial for effective adhesion, given the surface roughness of the 3D-printed mold. Once removed from the oven, the chip is filled with 1-butyl-3-methylimidazolium dicyanamide ([BMIM][N(CN)2]) (viscosity ~28 mPa·s) containing blue dye for visibility. Finally, plasma was applied to inlets, followed by a layer of E30CL two-part epoxy, Loctite Inc., for sealing. The overall dimensions of the chip are a 30×30 mm square that is 1.2 mm in thickness. Devices intended for human testing follow a similar fabrication process but at a lower thickness to reduce the mechanical load of the chip. Human testing devices included a top layer spun at 400 rpm and a bottom layer spun at 700 rpm, to achieve an overall thickness of 500 μm.

Benchtop Characterization

Fluid movement was characterized on the benchtop using a mechanical characterization tool MACH 1, Biomomentum Inc. The experimental process starts with setting the liquid interface at a roughly identical position for HAR and LAR channels and allowing it to settle for 5 minutes. Then the cyclic strain was applied and the liquid was allowed to settle before making a measurement. The measurements are all performed using ImageJ by manually measuring the liquid interface positions.

DIC Experimentation Methods

To quantify the skin strain, 3D digital image correlation (DIC) was performed using opensource MATLAB-based software NCORR. The DuoDIC algorithm, developed by D. Solav, allows us to accurately measure the skin by using two cameras and considering z displacement error. The camera system is composed of Raspberry Pi modules and a Raspberry Pi lens. The speckle pattern was applied to the skin using a temporary tattoo (Laser Tattoo Paper, FOREVER). To control the glare of the speckle pattern, a softbox lighting system was used. The inventors also found that applying baby powder on the tattoo reduces glare while maintaining appropriate contrast. The speckle pattern was generated using a Speckle Generator [Correlated Solutions, USA]. During imaging, three distinct shoulder movements were performed: abduction, shrug, and row. For each movement, a minimum of 5 images were taken throughout the range of motion. When processing the images, the DIC parameter subset radius was set to 30 and the subset spacing was set to 15. The SAMP locations and reservoir orientations were initially marked on the shoulder with a permanent marker to calculate the strain on the sensors.

Results

Two categories of experiments have been performed, 1) benchtop experiments as a proof of the operation principle of asymmetric pumping channels (APC) and their performance characterization, and 2) human volunteer experiments to demonstrate the capability to record human activity using SAMP.

Benchtop Experiments

Figure 4A:
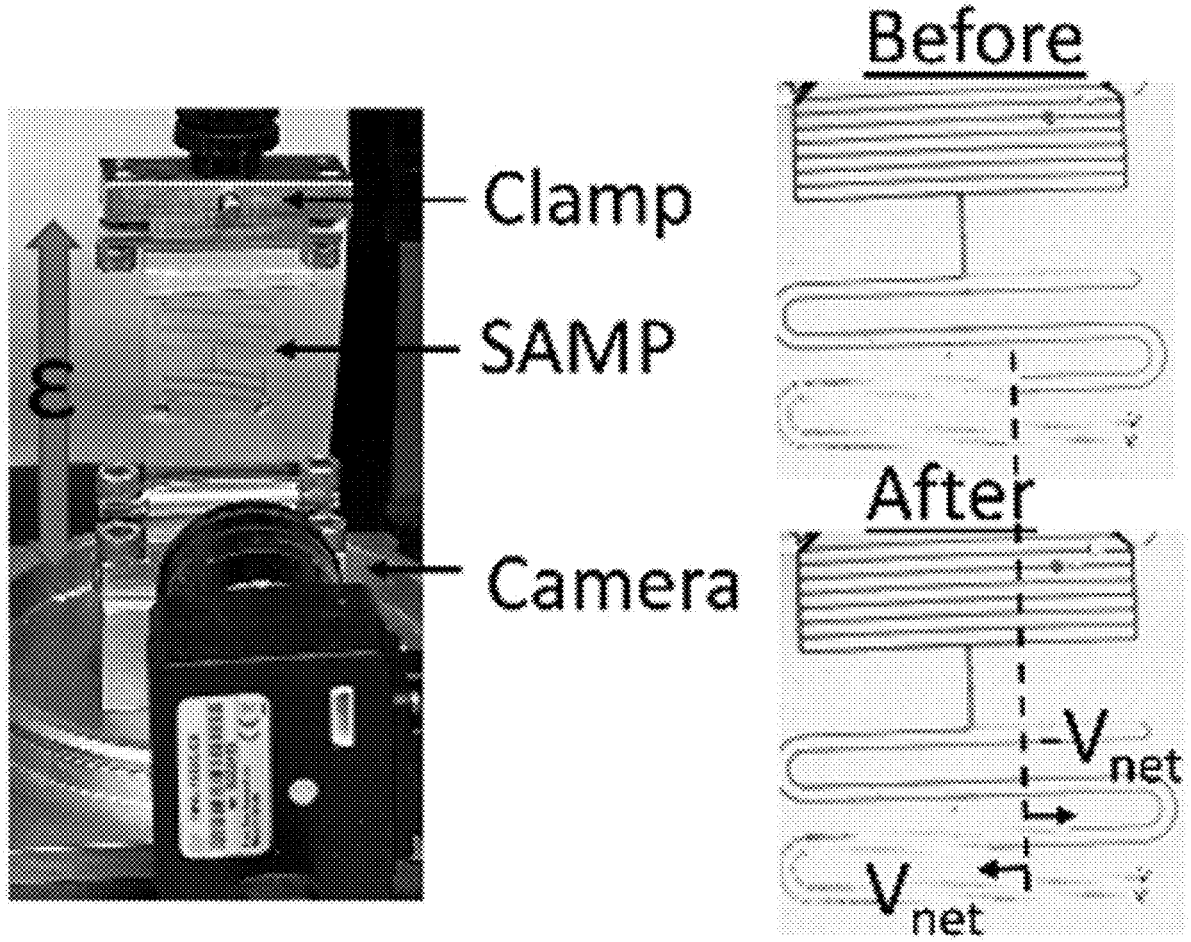
FIGS. 4A-F show according to an exemplary embodiment of the invention (FIG. 4A) a photo of the SAMP test setup and images of the SAMP before (top) and after (bottom) actuation at strain, ε=0.06, for five times. The volume displacement, $V_{net}$ for LAR is positive and $V_{net}$ for HAR is negative.
Figure 4B:
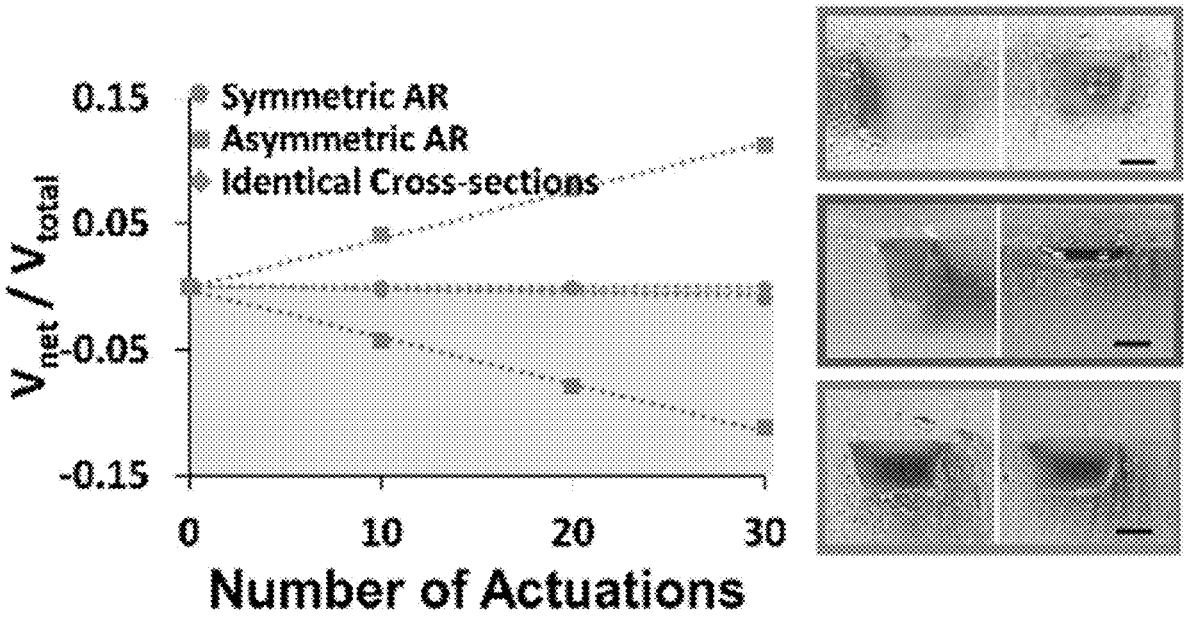

First, control experiments were performed to show that the asymmetry of pumping channel AR is a requirement for pumping. Three different pumping channel types were designed; 1) symmetrical (i.e., identical channel cross-section) 2) different cross-sections but symmetrical AR, and 3) asymmetrical AR (i.e., one high (>1), one low AR (<1)). Cyclic strain ($\varepsilon$=0.05) 10 times to each device was applied on the Mach-1 as shown in FIG. 4A and took a photo after waiting for 2 minutes and repeated this three times in total for thirty actuations. Due to the low viscosity of the working fluid (~28 mPa·s), the time constant was around two seconds and stabilization was achieved in about 15 seconds, therefore two minutes waiting time was sufficient for reaching steady-state. In each device, the inventors have taken two volume displacement measurements from two opposite pumping channels, and opposite signs were assigned to the volume displacement of each side of the channel (i.e., positive sign for LAR and negative sign for HAR). Net volume displacement to total volume displacement ratio was used as a performance parameter as described earlier. Then, these values were plotted for each side of the pumping channel for all three of the device designs. FIG. 4B shows the results of this experiment. Here, it is clear that the pumping occurs only for the design with asymmetric AR, and its direction is from HAR to LAR as predicted by theory.

Figure 4C:
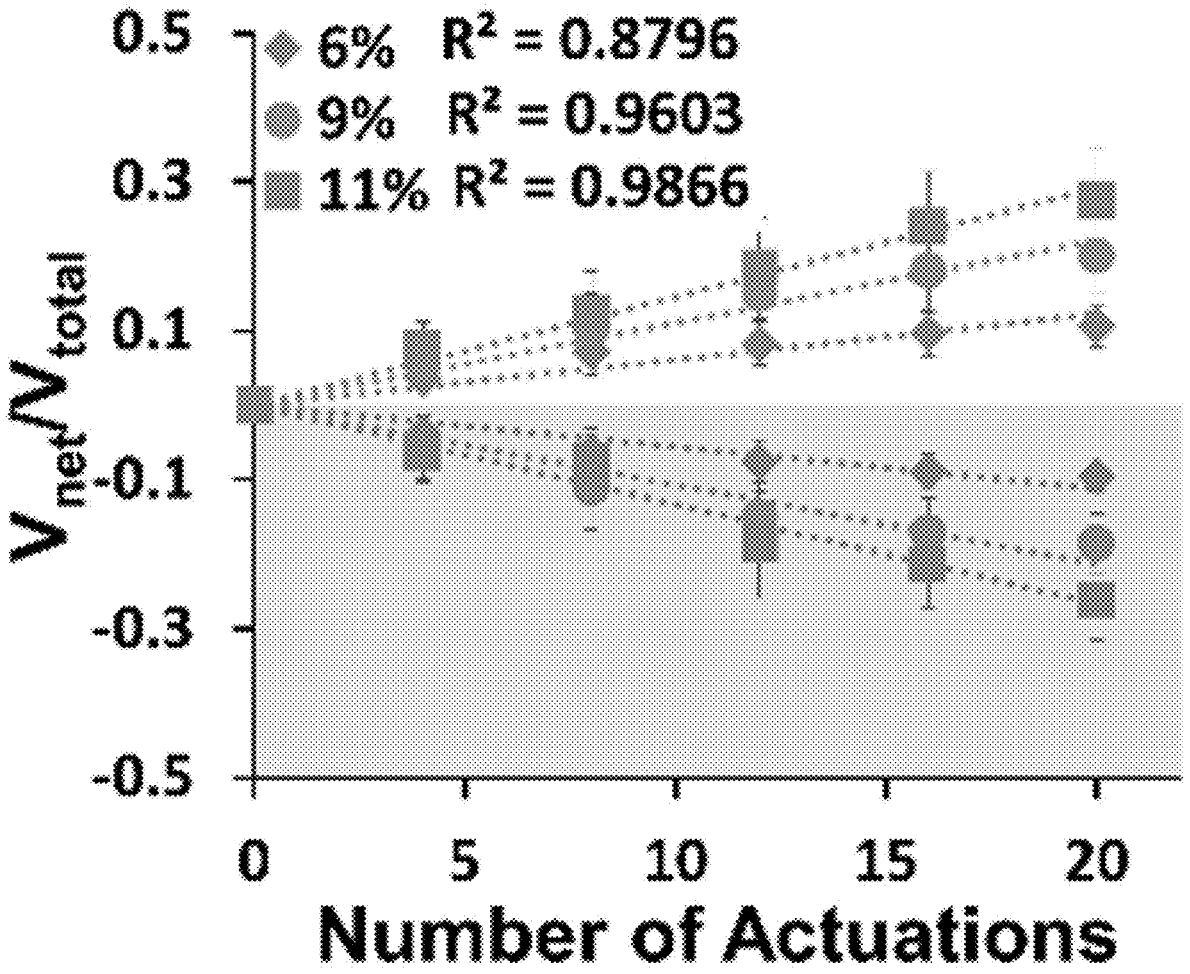
Figure 4D:
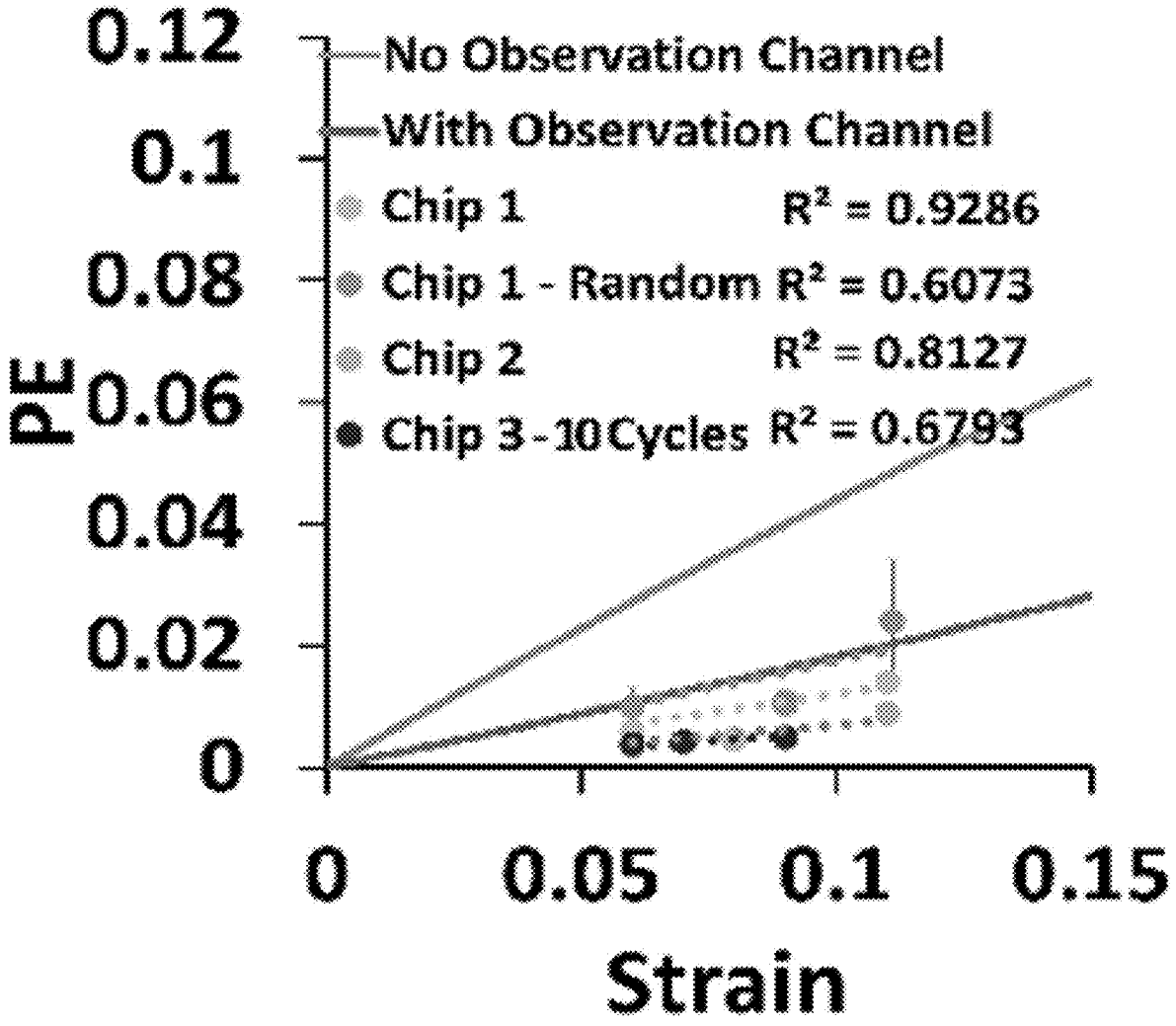

To investigate the effect of the strain on the pumping performance, an experiment was performed where the strain on the SAMP was varied. In this case, the inventors have actuated the devices at a predetermined strain in a second and released the strain in a second, and then waited for flow stabilization for about one minute. We repeated this four times before taking a photo of the device. Five such measurements for each strain value have been taken. This measurement was repeated three times and the average of the three experiments was found. FIG. 4C shows the results of this experiment. The best linear fit for each strain data was found. The slope of these fit lines gives us the pumping efficiency (PE). It is observed that as the strain increases the PE increases. This shows that the asymmetric deformation of the APC under uniaxial strain is responsible for pumping. This experiment was repeated in three pristine chips and performed four different experiments (i.e., Chip 1 is repeated in two different ways). In all cases, the inventors have observed increasing PE with strain as suggested by the theory. FIG. 4D shows the measured PE's from these experiments (i.e., Chip 1, Chip 1-Random, Chip 2, and Chip 3-10 Cycle) in comparison to theoretical calculations of PE (solid lines). Experimentally, the inventors have observed a decrease in linearity and higher noise when the strain values are applied in a random sequence (e.g. Chip 1-Random was tested three times at strain sequences of 1) 6, 9, 11%, 2) 9, 6, 11%, and 3) 6, 9, 11% and exhibited an $R^2$ of 0.6 as opposed to 0.9 when tested sequentially at 6%, 9%, and 11% strain). In addition, when strain values were applied in a continuous cycle of 10, there was a reduction in linearity, albeit there was no increase in the noise. For the theoretical calculations, experimentally measured channel dimensions were used shown in the inset of FIG. 4B (middle). The inventors observed that when the effect of the observation channel is not included, the experimental PE is at least a factor of four less than the theoretical calculations. However, when the effect of the observation channel is included, the experiments and theory are in much better agreement. This is because the observation channels on each side are identical, therefore, instead of contributing to the pumping, they are detrimental to the PE. The remaining discrepancy between theory and experiment can be due to the time dynamics of the application of the strain. For each strain, the strain in one second was applied as described infra. However, in theoretical calculations, it was assumed that the load is applied in an infinitesimally small time duration, therefore neglecting the time dynamics of the load function. Since the strain is applied slowly in the experiment, the liquid flow starts at lower strains and the measured PE should be compared to the convolution of the load function and the theoretical strain dependent PE.

Then, the above experiment was repeated without waiting for stabilization during the application of the strain as this is a realistic scenario in human activity tracking. In this case, the strain was applied consecutively 10 times and then waited for stabilization before the measurement. Here the strain dependent PE is still observed, however, there is a reduction in the PE and its linearity. The results of this experiment are summarized in FIG. 4D (Chip 3, red circles), as well.

Figure 4E:
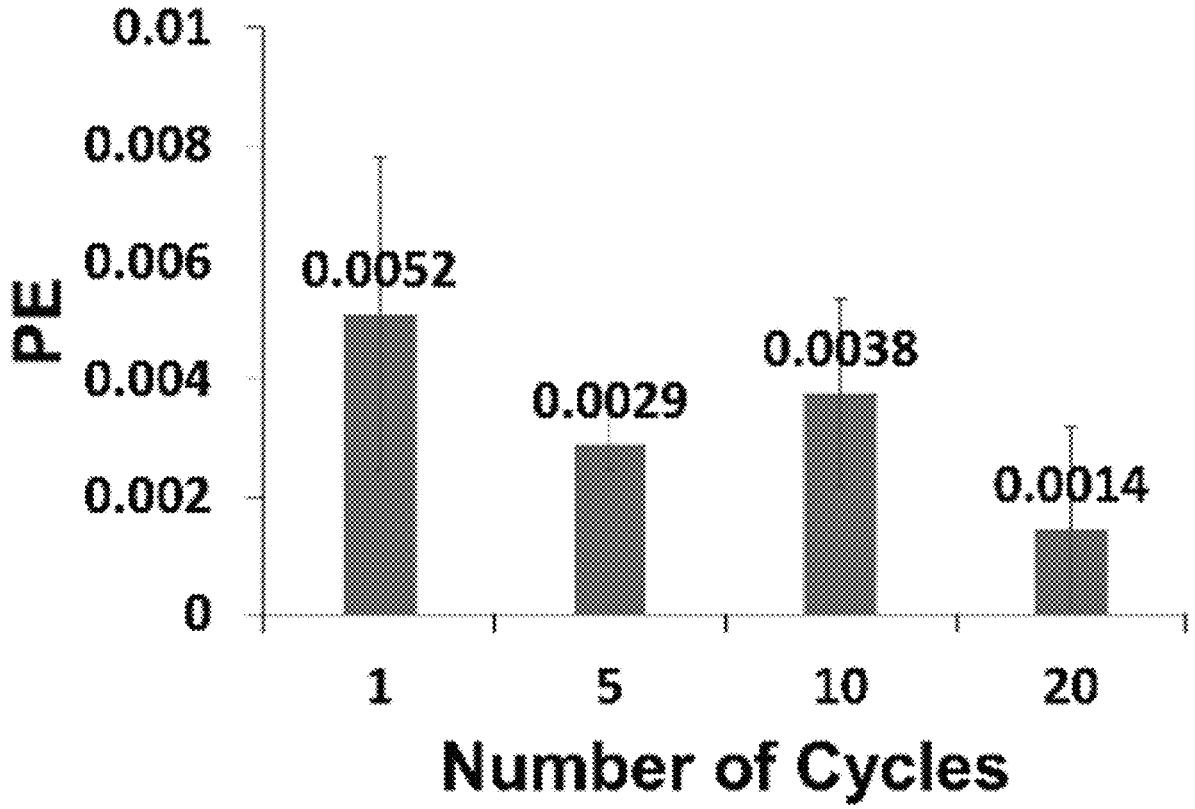

FIG. 4E illustrates how the dynamics of the cyclic strain influence the pumping efficiency of the SAMP for the identical strain values of 0.05. All of the data here is obtained on the same chip. When there is a waiting period for stabilization between individual actuations (1 cycle), the pumping efficiency is about 0.0051 whereas, when 10 cycles are applied back-to-back without any waiting periods, the pumping efficiency reduces. As the number of back-to-back cycles increases to 20, we see a further decrease in pumping efficiency to about 0.0014, nearly a factor of three less than when strain is applied after stabilization. This result can be intuitively understood as the stabilization of the liquid flow allows the pumping efficiency to reach its full performance. However, when stabilization is not allowed between each actuation, the liquid does not find enough time to complete its cycle hence the reduction in $V_{net}$ and PE is observed.

Figure 4F:
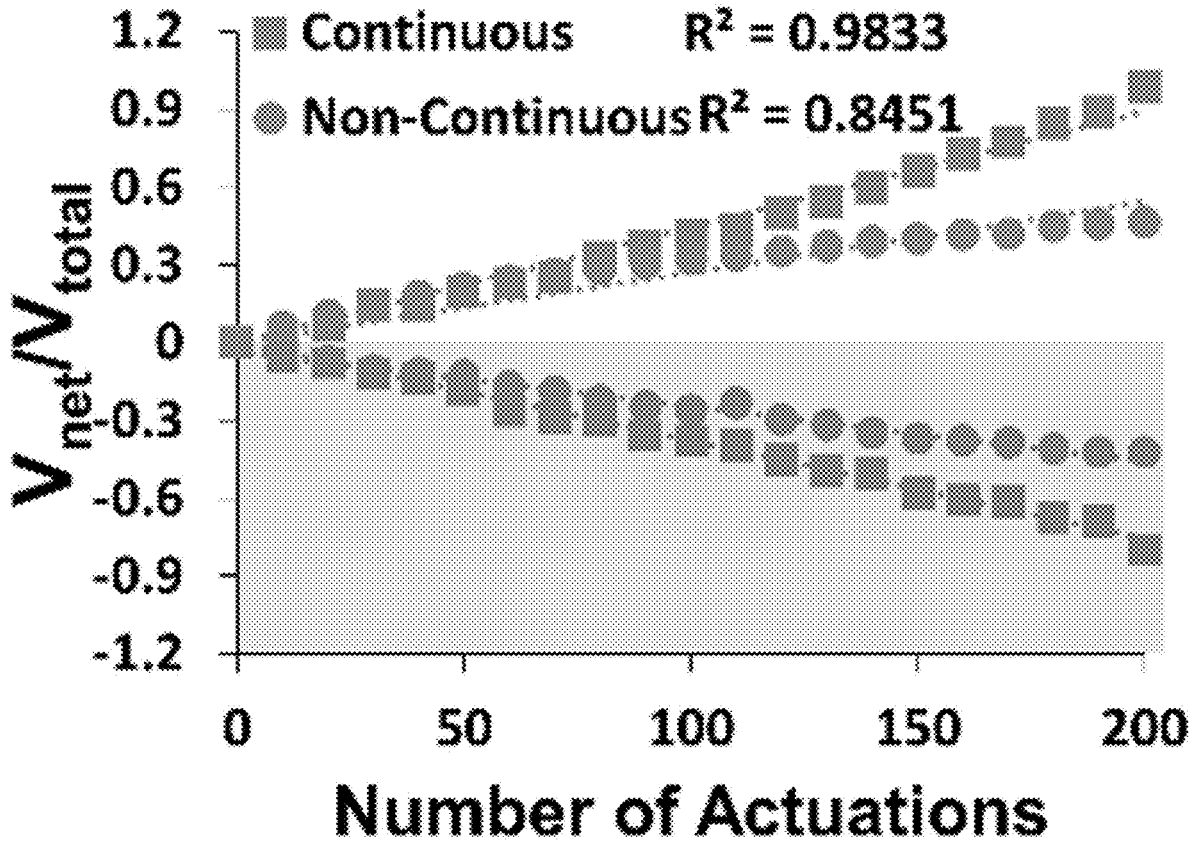

When the device undergoes hundreds of cycles of strain ($\varepsilon$=0.05), a reduction in linearity is observed as shown in FIG. 4F ('blue' circles). This was due to the additional resistance of the observation channels. As the pumping continues, the amount of liquid in the observation channel of LAR will increase whereas it will decrease for the observation channel in HAR. This will create a further imbalance between the two sides, reducing the PE. To improve the linearity, a new SAMP was designed. Here, the observation channel was eliminated and the APC were extended continuously throughout the device. FIG. 4F ('orange' squares) shows the results of an experiment using this new design over the course of 200 actuations. It can be seen that the continuous design produces significantly more linear results in comparison to the non-continuous design. One can also see a better PE performance from the continuous design (no observation channel) in agreement with the theoretical predictions (see FIG. 4D). The PE improvement was not as high as the theory predicts because the HAR side of the pumping channel was 3D-printed at a lower AR than the design value, at around AR of one.

Human Volunteer Experiments

After validating the operation and characterizing the performance of the SAMP on the benchtop experiments, the design characterized in FIG. 4C was used, for human activity quantification and recognition. Two locations for our experiments were determined; 1) wrist and 2) shoulder. The inventors had chosen the wrist hypothesizing that the smaller degree of freedom of the wrist would allow for simpler quantification of the wrist bending. The shoulder was chosen to test the SAMP's ability to recognize different exercise types. The shoulder joint is complex with much higher degrees of freedom compared to the wrist. It was hypothesized that exercise-dependent skin deformations on the shoulder can be used as a fingerprint of the exercise. Therefore, three SAMPs were simultaneously used during the shoulder experiments.

Wrist Experiments

Figure 5B:
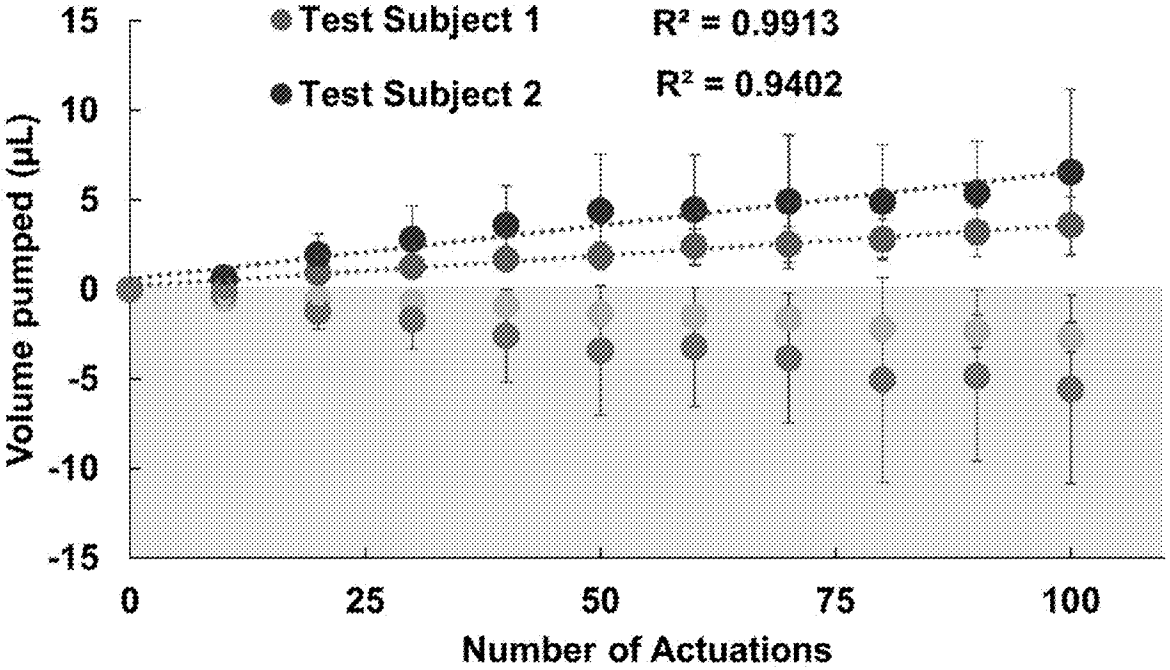
FIGS. 5A-B show according to exemplary embodiments of the invention (FIG. 5A) photos of the wrist during the experiment in neutral and extended positions. The support block allows the wrist to be extended at approximately the same angle each time.
Figure 5A:
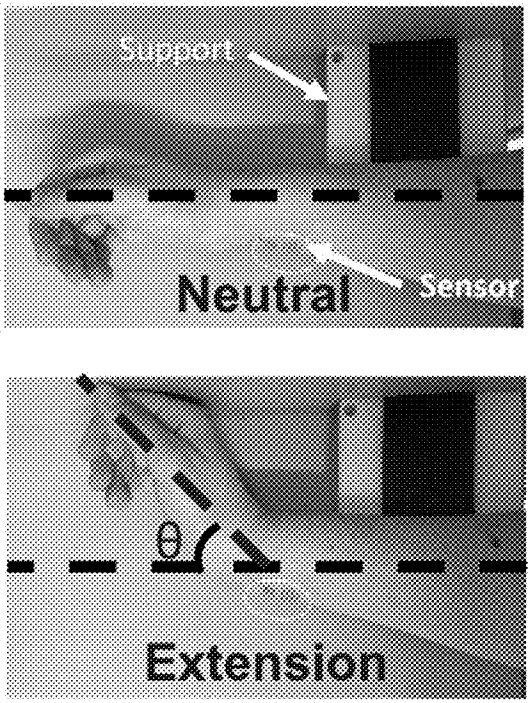

The device was adhered to the wrist using glue (SkinTite, Smooth-on Inc.), and then left to dry for 15 minutes. The arm lay on its side on a flat surface with a block to ensure the wrist extends the same angle in each trial. The exact location of the device on the wrist was marked to ensure all devices are placed consistently. Three devices were tested for 10 sets of 10 repetitions of the wrist extensions, with 2-minute waiting periods between each set to allow the liquid to settle before readout. The experiment setup and the results are shown in FIGS. 5A-B, respectively. Here the average of the results of three experiments are shown for two test subjects. The standard deviations are obtained from these three experiments. The best linear fit line is plotted for each subject. For both subjects, a strong correlation between the number of moves and the liquid displaced is observed. Test subject 2 observed a greater volume displacement per trial of 0.0205 μL/bending in comparison to Test subject 1 who exhibited 0.011 μL/bending. The data from Test subject 2 also had larger error between the measurements. These can be explained by the differences in biomechanical properties of the wrist (e.g., size, flexibility, skin elasticity, etc.) between the two subjects.

Shoulder Experiments

Due to the complexity of the shoulder, the shoulder experiments were started with strain measurements using digital image correlation (DIC). The inventors obtained the first and second Lagrangian skin strains (Epc1 and Epc2, respectively) as shown in FIGS. 6A-C for three different shoulder exercises. An interactive MATLAB script was used to outline SAMP locations and simultaneously plot Epc1 and Epc2 unit vectors at the SAMP locations as shown in FIG. 6D. Here the arrow directions represent strain orientation and the color gradients represent the strain magnitude. A straight line orthogonal to SAMP reservoirs (i.e., sensor orientation) was drawn. The unit vectors were then projected on the sensor orientation as demonstrated in FIG. 6E. The projections were then multiplied by their respective magnitudes (M1, M2). The sum of the two projected vectors represents the resultant strain magnitude at a given point. The average resultant strain magnitude, $<\varepsilon_R>$ in the sensor area is calculated from the individual $\varepsilon_R$ values.

Figure 7A:
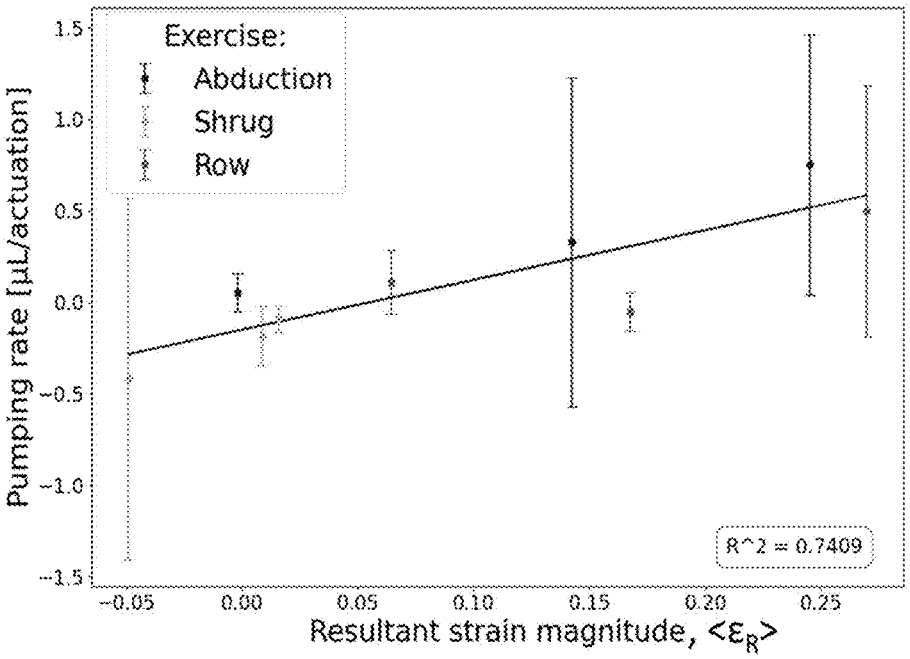
FIGS. 7A-B show according to exemplary embodiments of the invention (FIG. 7A) Average pumping rate per actuation with respect to average resultant strain magnitude. The SAMPs' liquid displacements were measured after each set (i.e., 10 repetitions) of exercises and divided by 10 to get the pumping rate. The blue line is the best linear fit with an $R^2$ value of 0.74.
Figure 7B:
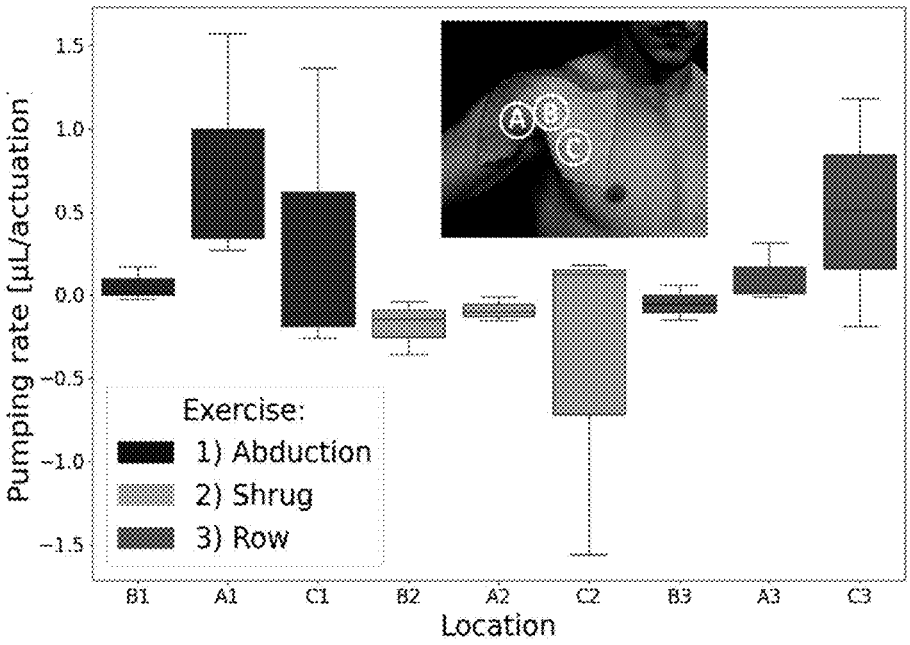

After the DIC analysis, three SAMP devices were placed on the shoulder at the pre-determined locations. Specifically, Chip A was placed on the proximal end of the biceps brachii muscle. Chip B was placed at the clavicular head of the pectoralis major. Chip C was placed on the sternum head of pectoralis major lateral from the midline as shown in FIG. 7B. These locations and movements were chosen based on the large strain magnitudes and movement dependent strain variations on these areas. The actuators of the chips were placed closest to the center of the shoulder where the strain is greatest, forming a delta shape.

The SAMPs were tested for three exercises: shrug, abduction, and rowing. Each exercise was performed for 10 sets, each set consisting of 10 repetitions, with 2-minute rest intervals between each set given to allow the liquid to settle, similar to the wrist experiment. The photos of the SAMPs were taken at the end of each set. Three tests were completed with this procedure using pristine SAMPs each time. Each test involved performing all three exercises, but in a different order. FIG. 7A shows the average pumping rate per actuation (i.e., actuation is a single repetition of a move) with respect to the average resultant strain magnitude, $<\varepsilon_R>$, on the sensor. The average pumping rate is obtained from the slope of the above-described measurements of 10 data points (data not shown for brevity). The error bars are the standard deviations of the pumping rates from the three tests. Despite being obtained from different locations and exercises, there is a good correlation (correlation coefficient=0.86) between the average strain the chips are experiencing and the liquid volume pumped, indicating that SAMP based measurement is a viable approach for recording different human movements in fluidic domain. The box plot shown in FIG. 7B was used to summarize our results and observe the movement dependent pumping response. The median is marked as the horizontal line inside the colored box. The box represents the interquartile range (IQR) with the bottom edge marking $25^{th}$ percentile and the top edge the $75^{th}$ percentile. The whiskers stretching vertically outside the box represent the variability of minimum and maximum in comparison to IQR. It can be seen that the abduction ('blue' boxes) results in large positive pumping only in chip location A, whereas rowing ('green' boxes) results in large positive pumping only in chip location C. Distinctly, shrug ('orange' boxes) results in mostly negative pumping in all locations. These results indicate that our approach is suitable for distinguishing different moves from each other. For conclusive results, there is a need for experiments with a larger number of subjects, exercises, and repetitions.

CONCLUSION

The inventors have designed and fabricated a skin-mountable strain actuated microfluidic device for the image-based tracking of human activity without the requirement for motion capture or flexible electronics. The device operation mechanism is explained through the coupling between the mechanical deformation of elastomeric channels and their hydraulic resistances. The inventors have identified the asymmetry in the aspect ratio of channels as a way to control the deformation induced hydraulic resistance changes. The presented device is a strain-actuated microfluidic pump (SAMP) that converts cyclic strain into linear liquid flow by utilizing the asymmetric flow resistance generated in two halves of the strain cycle without requiring any moving parts or high flow rates. A simplified equivalent electrical circuit model was developed of the asymmetric pumping channels of the device that includes a simple theoretical deformation model of microchannels. The model accurately predicts the device performance. Overall, SAMP acts as a memory device that records strain data. Since human activity generates skin strain, a skin-mounted SAMP records human activity. It was demonstrated this on two body positions, the wrist, and the shoulder. It was further shown that the resulting liquid position at the end of an activity period has the potential to inform the user of the type and intensity of an exercise. For the analysis of multiple activities of complicated joints such as shoulders, there is a need for multiple SAMPs. The unique pumping rate from each of these SAMPs can be measured for each exercise and their combined data would allow the differentiation of several movements.

What is claimed is:

1. A skin-strain-actuated microfluidic pump (SAMP), comprising:

(a) an actuator array of channels, wherein the channels are positioned more or less parallel to each other and fluidically connected capable of generating a reversible fluidic displacement caused by an in-plane strain;

(b) two asymmetric pumping channels fluidically connected to each other at a connection point, wherein the connection point is fluidically connected by a single channel to the actuator array of channels, and wherein cross-sections of each of the two asymmetric pumping channels are asymmetric from each other; and (c) two liquid displacement quantification channels, wherein one of the two liquid displacement quantification channels is fluidically connected to one of the two asymmetric pumping channels, and the other of the liquid displacement quantification channels is fluidically connected to the other of the two asymmetric pumping channels, wherein a difference in deformation characteristics of each of the two asymmetric pumping channels caused by the asymmetry of the cross-sections results in an asymmetric flow in the two asymmetric pumping channels.

2. The skin-strain-actuated microfluidic pump as set forth in claim 1, wherein the difference in the deformation characteristics of each of the two asymmetric pumping channels caused by the asymmetry of the cross-sections is defined as a ratio in hydraulic resistance for each of the two asymmetric pumping channels.

3. The skin-strain-actuated microfluidic pump as set forth in claim 1, wherein the cross-sections of the two asymmetric pumping channels have an aspect ratio defined by a height to a width ratio of the respective cross-sections, wherein a difference or asymmetry in the aspect ratios causes the difference in the deformation characteristics of each of the two asymmetric pumping channels caused by the asymmetry of the cross-sections.

4. The skin-strain-actuated microfluidic pump as set forth in claim 1, wherein the cross-sections of the two asymmetric pumping channels are circular, elliptical or triangular with dimensional asymmetry from one cross-section to the other cross-section.

5. The skin-strain-actuated microfluidic pump as set forth in claim 1, further comprising a working liquid flowing through the actuator array of channels, the two asymmetric pumping channels and the liquid displacement quantification channels.

* * * * *